US006361613B2

(12) United States Patent
Lee

(10) Patent No.: US 6,361,613 B2
(45) Date of Patent: Mar. 26, 2002

(54) METHOD FOR PICKLING METTALIC SURFACE, PICKLING SOLUTIONS THEREFOR, AND PROCESS FOR REGENERATING SPENT PICKLING SOLUTIONS

(76) Inventor: Ki Won Lee, 108-10, I1-dong, Ansan-si, Kyunggi-do 425-150 (KR)

( * ) Notice: Subject to any disclaimer, the term of this patent is extended or adjusted under 35 U.S.C. 154(b) by 0 days.

(21) Appl. No.: 08/983,602

(22) PCT Filed: Apr. 29, 1997

(86) PCT No.: PCT/KR97/00069

§ 371 Date: Dec. 24, 1997

§ 102(e) Date: Dec. 24, 1997

(87) PCT Pub. No.: WO97/41278

PCT Pub. Date: Nov. 6, 1997

(30) Foreign Application Priority Data

| | | |
|---|---|---|
| Apr. 29, 1996 | (KR) | 96-13475 |
| Sep. 2, 1996 | (KR) | 96-37791 |
| Apr. 15, 1997 | (KR) | 97-13885 |

(51) Int. Cl.[7] ..... C09K 13/04; C09K 13/08; C23G 1/02; C23G 1/36

(52) U.S. Cl. ..... 134/3; 134/10; 134/13; 134/41; 252/79.1; 252/79.2; 252/79.3

(58) Field of Search ..... 134/3, 10, 13, 134/41; 252/79.1, 79.2, 79.3; 423/DIG. 1

(56) References Cited

U.S. PATENT DOCUMENTS

| | | | | |
|---|---|---|---|---|
| 3,936,316 A | | 2/1976 | Gulla | 134/3 |
| 4,144,092 A | | 3/1979 | Krepler | 134/12 |
| 4,200,612 A | * | 4/1980 | Lamaze | 423/70 |
| 4,400,289 A | * | 8/1983 | Geldner et al. | 134/3 |
| 4,572,743 A | | 2/1986 | Müller et al. | 134/3 |
| 5,108,544 A | * | 4/1992 | Hakansson | 156/664 |

FOREIGN PATENT DOCUMENTS

| | | |
|---|---|---|
| JP | 4333583 | 11/1992 |
| WO | WO93/21362 | * 10/1993 |

* cited by examiner

*Primary Examiner*—Zeinab El-Arini
(74) *Attorney, Agent, or Firm*—Cantor Colburn LLP

(57) ABSTRACT

A method for removing scales formed on iron-based metal alloy containing Ni and/or Cr comprising contacting the metal alloy with a pickling solution containing nitrates and fluorides as essential components. The nitrates and fluorides used for the method are superior to the mixture of nitric acid and hydrofluoric acid in pickling efficiency, fundamental elimination of noxious gas; and optional abbreviation of pre-treatment before pickling. The pickling solution may also contain auxiliary component. A pickling composition containing nitrates and fluorides and a regenerating method of spent pickling solution is also provided.

10 Claims, 1 Drawing Sheet

METHOD FOR PICKLING METTALIC SURFACE, PICKLING SOLUTIONS THEREFOR, AND PROCESS FOR REGENERATING SPENT PICKLING SOLUTIONS

This is a national stage application of PCT/KR97/00069 filed Apr. 29, 1997.

BACKGROUND OF THE INVENTION

1. Field of the Invention

This invention relates to a method and composition for removing scale and rust (hereinafter referring to as simply 'scale') from a metal surface.

Particularly this invention relates to a method for efficiently removing the scale especially on stainless steel and other alloyed steel containing Ni and/or Cr without forming NOx gases, pickling solutions used for the method and a process for the regeneration of spent pickling solutions resulting from the method.

As is well known, stainless steel is widely used in various industrial applications due to its superiority in properties including corrosion resistance, oxidation resistance, and high temperature strength. Such stainless steels can be classified by its alloy composition into Cr-Stainless Steel (Cr: 11–27 wt %) and Ni-Stainless Steel (Cr: 15–28 wt %, Ni: 4–22 wt %). Further the Cr-stainless steel can be classified by its metallurgical structure into ferritic stainless steels and martensitic stainless steels, and the Ni-stainless steel can be classified into austenitic stainless steels and dual phase stainless steel having both ferrite phase and austenite phase.

Conventionally the stainless steel and other alloyed steel containing Cr and/or Ni are heattreated for high temperature oxidation after or during hot or cold rolling in production process or even on welding operation on finished products.

During the heat treatment, scales of oxides or carbides having a dense structure hard to be oxidized are formed on the surface of the stainless steel or the alloyed steel.

Since stainless steel contains Ni and Cr as essential components and Mo, Ti, Mn, Zr, Nb, N and other elements as additional components, the scales formed during the heat treatment consists mainly of Fe, $Fe_3O_4$, $Fe_2O_3$, NiO, $Ni_3O_4$, $Ni_2O_3$, $CrO_3$ and $Cr_2O_3$.

As described above, since the scale has dense structures and is hard to be oxidized, it is hardly removed by a conventional pickling process.

Therefor to easily remove those scales, the stainless steel or other alloyed steels are typically pre-treated using salt bath, shot-blast or neutral salt electrolysis in chemical, physical or electrical way, respectively, before pickling.

By the pre-treatment, the scales on the surface can be partially removed to a certain extent and then completely removed by dipping in a conventional pickling solution.

However each of the pre-treatment processes using shot-blast, salt bath or neutral salt electrolysis has several problems as described below:

The pre-treatment using shot-blast is brought about by shotting spheroidal particulates of metal or glass onto the surface of metal under high pressure to physically remove the scale formed on substrate to increase the effect of pickling process to be followed.

However such pre-treatment using shot-blast may degrade the surface roughness of substrate and may cause dust formation.

The pre-treatment using salt bath is brought about by dipping the substrates on which the scales are formed into the salt bath containing sodium hydroxide, sodium nitrate, and sodium chloride in a temperature range from 480 to 520° C. to improve the pickling efficiency by softening the scale structure.

However using the salt bath may produce $Cr^{+6}$ which may give rise to environmental problems and requires increased energy consumption.

The pre-treatment using neutral salt electrolysis is brought about by applying electric power to the solution containing neutral salt such as sodium sulfate to form bubbles to improve the pickling efficiency by softening the scale structure with the formed bubble.

However the use of this neutral salt also has the disadvantage that energy consumptions are increased.

In addition to the above-described disadvantages of each pre-treatment method, pre-treatment itself increases the length of the process.

After conducting such pre-treatment as described above, the substrate covered with scales are treated with pickling solution in order to obtain completely bared surfaces.

Conventionally aqueous blends containing hydrofluoric acid and nitric acid are used as pickling solutions. Optionally different classes of compounds including hydrochloric acid and sulfuric acid can be added to the pickling solution.

The components and composition ratios of the pickling solution can be varied depending on the type of substrate and end use.

During the pickling process using the mixed acid substantially of hydrofluoric acid and nitric acid, the metal ions formed on the substrates are believed to react with the mixed acid as follows;

$$Fe^0+6H^++6NO_3^-\rightarrow Fe^{3+}+3NO_2\uparrow+3H_2O+3NO_3^- \quad (1\text{-}1)$$

$$Ni^0+6H^++6NO_3^-\rightarrow Ni^{3+}+3NO_2\uparrow+3H_2O+3NO_3^- \quad (1\text{-}2)$$

$$Cr^0+6H^++6F^-\rightarrow Cr^{+3}+3HF+3/2H_2\uparrow+Fe^- \quad (1\text{-}3)$$

$$Fe^{+3}+nHF\rightarrow FeFn^{(3-n)}+nH^++nF^- \quad (1\text{-}4)$$

As shown in the above, when pickling process is carried out in conventional manners, noxious and corrosive hydrohalide acid fumes may be liberated into the atmosphere to cause environmental contaminations.

Specifically the nitric acid reacts with the metal ions of the scale to form the noxious NOx gases representing nitrogen oxide and the NOx gases formed during the pickling process are released into the atmosphere, while unreacted nitric acid and volatile hydrofluoric acid are simultaneously volatilized into the air to give rise to additional environmental problems. (HF: Specific gravity 0.987, Boiling Point 19.4° C., Melting Point −92.3° C., $HNO_3$: Specific gravity 1.502, Boiling Point 86° C., Melting Point −42° C.).

Therefore there has been a need for a method of pickling and a pickling solution to avoid the disadvantages inherent in the conventional pickling method and solution, and preferably a method of pickling and a pickling solution in which any pre-treatment process could be abbreviated.

U.S. Pat. No. 4,572,743 discloses a method for pickling metallic surfaces especially unalloyed steel surfaces prior to further treatment by phosphating and varnishing in order not only to decrease the workpiece but also to remove rust and scale formed thereon.

The '743 reaches to use non-aqueous pickling system based on organic solvent, especially to use homogeneous organic pickling solutions based on low-boiling halogenated hydrocarbons as the basic component to avoid the disadvantages of aqueous pickling system.

U.S. Pat. No. 3,936,316 discloses a process and composition for pickling metals especially iron based metals prior to metal finishing. The '316 teaches to use the hydrohalide pickling solution containing urea in order to reduce or completely eliminates the excessive liberation of noxious and corrosive hydrohalide acid fumes.

Non of these references did not disclose or suggest any pickling method or solutions which could fundamentally eliminate the problems inherent in the conventional pickling method and solution such as liberation of noxious gases, cost increase, low efficiency of pickling process and necessity of pre-treatment.

A need therefore exists for an improved pickling method and solution which could fundamentally avoid the disadvantages of conventional pickling systems, preferably together with an improved process for regenerating and recycling the spent pickling solutions which could reduces the cost of pickling operation.

One object of the invention is to provide a generally improved method for pickling iron based metal alloys containing Cr and/or Ni, which is capable of obviating the problems in the prior art.

Another object of the invention is to provide a method which is capable of removing the scales of oxides or carbides without forming noxious gases which is injury to personnel and which does not impair the efficiency of the pickling process itself.

A further object of the invention is to provide a method for pickling metal without conducting pre-treatments before pickling process.

Another object of the invention is to provide a method for pickling metal which could reduce the cost of pickling operation and increase the process efficiency.

A further object of this invention is to provide a pickling solution which can be used for removing the scale formed on the metal, which do not cause the formation of noxious gases injurious to personnel.

Another object of the invention is to provide a pickling solution which can be use for efficiently removing the scale formed on the metal without conducting pre-treatments before pickling process.

And a further object of this invention is to provide a process for efficiently regenerating the resultant spent pickling solution after pickling process.

Upon further study of the specification and appended claims, further objects and advantages of this invention will become apparent to those skilled in the art.

SUMMARY OF THE INVENTION

The invention in the first aspect discloses a method for pickling a metal surface to remove the scale formed thereon, comprising contacting the metal surface with a pickling solution comprising, as essential components, nitrate and fluorides, and, as optional components, at least one selected from the group consisting of sulfuric acid, sulfates, phosphoric acid, phosphates, peroxides, amines and amides, nitric acid, sulfonic acid and sulfonates.

In this aspect, the metal surface on which scales are formed is contacted with the pickling solution containing not mixed acids such as hydrofluoric acid and nitric acid but nitrates and fluorides, and thereby not only noxious or toxic gases including NOx gases which represents nitric oxides and hydrohalide acid fumes are not generated but also the efficiency of the pickling can be improved.

Further this method can abbreviate the pretreatment conventionally used in prior art with maintaining or even improving the pickling efficiency, thereby the line of process may be reduced.

The invention in the second aspect discloses a pickling composition useful for the method for pickling a metal surface according to the invention wherein the pickling solution comprising an effective pickling amount of a mixture of nitrate and fluorides, as essential components; and optionally at least one selected from the group consisting of sulfuric acid, sulfates, phosphoric acid, phosphates, peroxides, amines and amides, nitric acid, sulfonic acid and sulfonates.

Further according to the third aspect of this invention there provided a process for efficiently regenerating spent pickling solution after pickling, which comprises; contacting a metal surface with the pickling solution containing nitrates and fluorides to remove the scale formed on the metal surface; filtering the resultant spent pickling solution to separate liquid phase containing metal ions dissolved during pickling and solid phase mainly composed of oxidized steel and sludge, and then recovering the solid phase; cooling the filtrates to deposit the dissolved metal ion as metal salt and then recovering the metal salt; and recycling the resultant regenerated pickling solution for use in further process.

Further according to the forth aspect of this invention, there provided a process for efficiently regenerating spent pickling solution after pickling, which comprises;

contacting a metal surface with the pickling solution containing nitrate and fluorides to remove the scale formed on the metal surface; filtering the resultant spent pickling solution to separate liquid phase containing metal ions dissolved during pickling and solid phase mainly composed of oxidized steel and sludge, and then recovering the solid phase; passing the filtrates into ion exchange resin tube to absorb the metal ion; and recycling the resultant regenerated pickling solution for use in further process.

According to the process for regenerating spent pickling solution of this invention, the spent pickling solution containing metal dissolved during pickling process can be efficiently regenerated with maintaining the metal ion concentration below a predetermined level and additionally iron oxides and metal salt can be attained as by-products.

DETAILED DESCRIPTION OF THE PREFERRED EMBODIMENT

Figure 1:
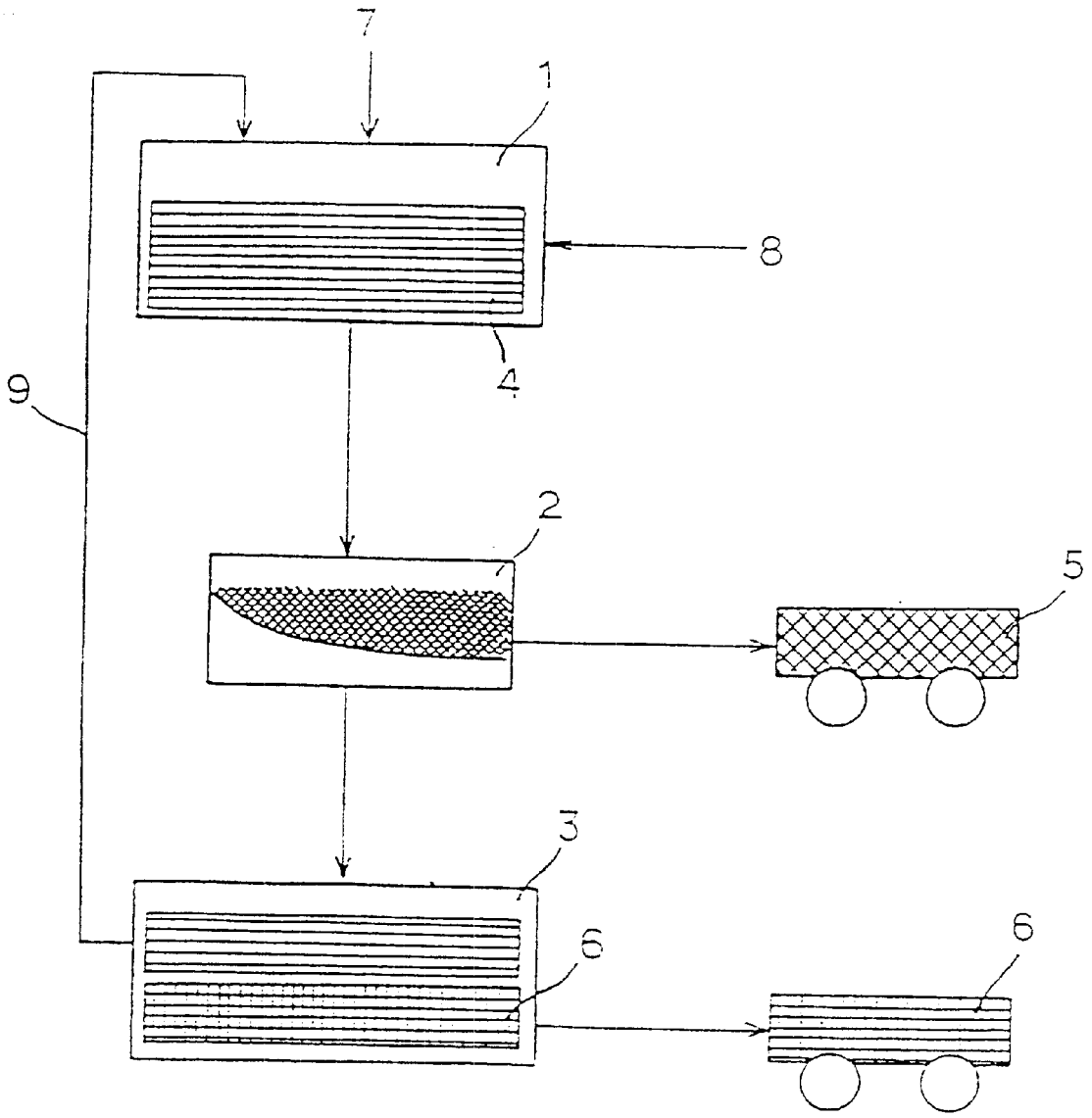
FIG. 1 is a flow sheet of block diagram illustrating an embodiment of the regenerating process of the present invention.

We conducted experiments in various method to find improved pickling solution which obviate aforementioned problems inherent in the prior art and which could substitute for the conventional pickling solution containing a mixture of hydrofluoric acid and nitric acid.

As a result, we surprisingly discovered that nitrates and fluorides which are inherently less corrosive than nitric acid and hydrofluoric acid, respectively, exerted superior activity to the conventional mixture of nitric acid and hydrofluoric acid, when used as a pickling solutions. Additionally, we also found when used aqueous solution of nitrates and fluorides as pickling solution, the corrosion into the substrate by the pickling solution has been dramatically decreased.

Based on those discoveries, we continued to study and finally completed the invention.

The pickling method, pickling composition and the method of regenerating spent pickling solution according to the invention can be applied to remove the scale and/or rust formed or the surface of the stainless steel and other iron based metal alloy containing Cr and/or Ni by heat treatment, whenever the removal of scale and rust is required, for example, in production, or before finishing or before end use.

The method for pickling according to the first aspect of this invention comprises contacting the metal surface with a pickling solution comprising; as essential components, nitrates and fluorides and, as optional components, at least one selected from the group consisting of sulfuric acid, sulfates, phosphoric acid, phosphates, peroxides, amines and amides, nitric acid, sulfonic acid and sulfonates.

The nitrates and fluorides used as essential component of the pickling solution can sequentially be applied to the substrate to be treated and preferably can also be applied in a combined form.

The optional components can also sequentially be applied to the substrate. Preferred is to use in a combined form with the essential components, which constitutes the second aspect of this invention.

According to this invention, by using aqueous nitrate and fluorides as the essential components of pickling solution in stead of using the mixture of nitric acid and hydrofluoric acid as used in the prior art, noxious NOx gases including NO, $NO_2$ are not produced and furthermore the scales formed on the substrate such as stainless steel and other iron based metal alloys containing Ni and/or Cr by heat treatment can efficiently be removed even when any pre-treatment using shot blast, salt bath or neutral salt electrolysis are not conducted before pickling.

The reason why the salt form of nitric acid and hydrofluoric acid exert superior activities to the nitric acid and hydrofluoric acid in removing the scales has not theoretically clarified.

However we assume that the nitric acid and hydrofluoric acid are too corrosive, and thus when contacted with a substrate to be treated the mixture of nitric acid and hydrofluoric acid not only attribute to remove the scale formed on the substrate but also directly penetrates and eats into the metal substrate, which results in decreasing the pickling efficiency and damaging the bare surface of the metal substrate.

That is, it is presumed that not all of the mixture of nitric acid and hydrofluoric acid are used for removing by dissolving the scale and but a portion of the mixture is inefficiently used for eating the substrate itself.

On the other hand, when nitrate and fluorides are used as essential component of pickling solution, these components preferentially dissolve Ni or Fe component in the scale rather than Cr component which has dense grain structure.

Then the pickling solution penetrates through the gap formed by the dissolution of Fe or Ni components toward the surface of the substrate on which the undissolved Cr component still exists.

Upon arriving at the surface of the substrate, the pickling solution do not penetrate into or corrode the surface of the substrate having a high degree of grain structure.

In stead, the pickling solution flows along the interface between the surface of the substrate and the scale layer which is mainly composed of Cr, which results in a physical separation of the substrate and the scale layer.

Thus we assume that the superior pickling effects of the pickling solution containing nitrates and fluorides as essential components according to this invention are attributed to not only chemical reaction in which less-dense components including Ni and Fe are dissolved or corroded by the pickling solution but also physical separation of the scale mainly composed of Cr from the substrate after the chemical reaction.

Such scale-removing mechanism can not be found in the prior pickling solution which contains a mixture of nitric acid and hydrofluoric acid which indiscriminately dissolve or corrode not only all components of the scale but also the substrate through chemical reaction only.

Additionally it is to be noted that the activity of the conventional pickling solution containing nitric acid and hydrofluoric acid dramatically decreases as the metal ion concentration in the pickling solution increases by the elution of Fe, Cr and Ni ion during pickling process even though its initial activity is very high.

Therefore fresh mixture of nitric acid and hydrofluoric acid should be continuously supplied to the pickling solution to maintain the activity.

Furthermore, in the prior art using the mixture of nitric acid and hydrofluoric acid, the removal of scale relies only upon the chemical reaction as discussed above.

Thus the scales having a dense structure and of the type hard to be oxidized can not be efficiently removed, which requires additional pre-treatments using shot-blast, salt bath or neutral salt electrolysis.

However, the pickling solution of the invention efficiently removes the scale through chemical reaction and physical separation following to the chemical reaction, and thus additional pretreatments are not required.

And as the physically separated scale layers go down onto the bottom of pickling bath in solid state, they can be easily recovered or retrieved.

As earlier stated, the pickling solution in which nitrates and fluorides are used as essential components according to the present invention does not produce environmentally-detrimental and noxious nitrogen oxides (NOx) or hydrofluoric acid fumes.

This matter will be discussed in detail below.

During the pickling process using the pickling solution according to the invention, following reactions are proceeded.

$$Fe+2XNO_3=Fe(NO_3)_2+2X \quad (2\text{-}1)$$

$$FeO+2XNO=Fe(NO_3)_2+X_2 \quad (2\text{-}2)$$

$$Fe_2O_3+6XNO_3=2Fe(NO_3)_3+3X_2O \quad (2\text{-}3)$$

$$Fe_3O_4+8XNO_3=Fe(NO_3)_2+2Fe(NO_3)_3+4X_2O \quad (2\text{-}4)$$

$$Ni+2XNO_3=Ni(NO_3)_2+2X \quad (2\text{-}5)$$

$$NiO+2XNO_3=Ni(NO_3)_2+X_2O \quad (2\text{-}6)$$

$$Cr+4YF=CrF_3+YF+3Y \quad (2\text{-}7)$$

$$Cr_2O_3+6YF=2CrF_3+3Y_2O \quad (2\text{-}8)$$

$$2CrO_3+6YF+2Fe=2CrF_3+Fe_2O_3+3Y_2O \quad (2\text{-}9)$$

As shown in the above, the nitrates and fluorides are reacted to form metal compounds which are not detrimental or noxious.

Examples of nitrates which can be used for the invention may include sodium nitrate, sodium nitrite, barium nitrate, potassium nitrate, calcium nitrate, potassium nitrite and ammonium nitrate.

And examples of fluorides which can be used for the invention may include ammonium fluorosilicate, sodium fluorosilicate, magnesium fluorosilicate, acid potassium fluoride, acid ammonium fluoride, acid sodium fluoride, fluoroboric acid, ammonium fluoroborate, potassium fluoroborate, sodium fluoride, barium fluoride, and potassium fluorosilicate.

Optionally to complement the activity of pickling solution, reaction accelerators or auxiliary agent in an effective amount can be added into the pickling solution.

Examples of such accelerators or auxiliary agent may include sulfuric acid, sulfates, phosphoric acid, phosphates, peroxides, amines, amides, nitric acid, sulfonic acid and sulfonate.

And as an auxiliary agent surface active agents can also be added into the pickling solution.

Sulfuric acid, sulfates sulfonic acid and sulfonates function as solubilizers for the metal substrate and metal oxides and reduce the increasing rate of metal ion concentration in the pickling solutions during pickling process with their high capacity of capturing the metal ion eluted during pickling process.

Examples of the sulfates may include magnesium sulfate, manganese sulfate, sodium sulfate, potassium sulfate, ammonium sulfate, ammonium persulfate, and ammonium sulfite.

Phosphoric acid and phosphates serve as inhibitors for protecting the bare metal surface of he substrate from corrosion, specially corrosion by inorganic acid such as sulfuric acid in the pickling solution for ferritic or martensitic stainless steels.

Examples of the phosphates may include sodium phosphate, ammonium phosphate, sodium pyrophosphate, acid sodium pyrophosphate, calcium phosphate and potassium phosphate.

Peroxides accelerates scale-removing reaction, and may include hydrogen peroxides.

Amines or amides can be added to previous $H^+$ion from approaching from the pickling solution to the surface of metal substrate or to prevent $Fe^{2+}$ion from diffusing from the metal surface to the pickling solution.

Examples of amines and amides may include hexamethylenediamine, diethylamine, dimethylamine, diethylethanoiamine, diethylthiourea, dimethylthiourea, diethylene diamine, cyclohexyl amine, sulfuric aminoguanidine, and ethanol amine.

Nitric acid can also be added into the pickling solutions in small amounts to attain passivity effects of stain less steels.

The pickling composition according to the second aspect of the invention comprises essential components consisting of nitrates and fluorides, and optionally at least one accelerator or auxiliary components selected from the group consisting of sulfuric acid, sulfates, phosphoric acid, phosphates, peroxides, amines and amides, nitric acid, sulfonic acid and sulfonates.

The ratio of nitrate to fluorides can be in the range between 1:9–9:1, preferably 3:7–7:3 based on the molar equivalents of nitric acid ion and hydrofluoric acid ion, though the ratio can properly be adjusted depending upon Ni and Cr contents in the steel, type and shape of the steel.

For example, when chrome oxides are contained in predominant amount the amount of fluorides will be increased and on the contrary when the amount of Fe or Ni oxides are contained in predominant amount the amount of nitrate will be increased.

The contents of the optional components used in the pickling solution according to the invention is between 1–30%, preferably between 10–15%, based on the volume of pickling solution and can be adjusted considering the functions of the optional components.

According to this invention there provided a process for efficiently regenerating spent pickling solution after pickling, which comprises; contacting a metal surface with the pickling solution containing nitrate and fluorides to remove the scale formed on the metal surface; filtering the resultant spent pickling solution to separate liquid phase containing metal ions dissolved during pickling and solid phase mainly composed of oxidized steel and sludge, and then recovering the solid phase; cooling the filtrates to deposit the dissolved metal ion as metal salts and then recovering the metal salt, or passing the filtrates into ion exchange resin tube to absorb the metal ion; and recycling the resultant regenerated pickling solution for use in further process.

In the regenerating process of this invention, a metal on which scales are formed is contacted with the pickling solution of the invention and then the resultantly formed solid phase including oxidized steel and sludge are removed through filtration.

After that, the liquid phase of filtrate are cooled to deposit and recover the metal ion in salt form or the filtrate are passed into ion exchange resin tube to absorb the metal ion. Through the above processing steps, all of the impurities formed during pickling process such as oxidized steel, sludge and metal ion can be removed or recovered, and the spent pickling solutions can be regenerated.

The regenerated pickling solutions are recycled for further pickling process.

As described above, the impurities formed during the pickling process and contained in the spent pickling solutions are sequentially removed in solid state, which eliminate the necessity of a large scale depollution facilities.

Additionally because that the impurities are removed in a solid state, the concentration of the pickling solutions are not suddenly reduced, which contributes to extend the life of the pickling solution.

Moreover the recovery of oxidized steel and metal salt as by-products adds another advantage to the present invention.

With reference to FIG. 1 of the drawing, the stainless steel on which scales have been formed is dipped into pickling bath 1 containing pickling solution 4 to remove the scales on the surface of the stainless steel.

The spent pickling solution is transferred to the filtration bath 2.

The solutions having transferred to the filtration bath 2 contain not only the separated scale from the substrate in flake form but also iron oxide, metal ions such as Ni and Cr and sludges.

In the filtration bath 2, the iron oxide and sludges in solid form are recovered through to filtration and the remaining filtrate is transferred to a separation bath 3.

The filtrate is cooled and the metal ions in salt form 6 are deposited and removed by the difference of solubility.

Then the regenerated pickling solutions are returned to the pickling bath 1 through conduit 9.

Fresh water and pickling agent can be supplied to the pickling bath 1 through the conduits 8 and 7.

Alternatively ion exchange resin can be used to absorb the metal ion contained in the filtrate in stead of conducting the cooling step.

The present invention will best be understood from the following examples which are not meant to limit the scope of the invention but which are intended to be illustrative thereof.

EXAMPLES

Example 1: Measuring $NO_x$ Gas Generated During Pickling Process

This example is to measure the amount of nitrogen oxide gas when pickling is proceed with the mixture of nitric acid hydrofluoric acid, and the pickling solution of this invention.

Comparative pickling solution and pickling solution of this invention were prepared in the 1.21 erlenmeyer flask as below and then temperature of each solution was maintained at 50° C. Inlet of the erlenmeyer flask was equipped gas analysis instrument (Model No. 1MR-3000P, Made in Germany) and specimen was dipped. Kinds and amount of gases generated were measured per one minute for 7 minutes and the results are set forth below in table 1a–1d.

1a, 1b, 1c and 1d show the results of pickling in line heat treated specimen with comparative pickling solution, pickling off line heat treated specimen with comparative pickling solution, pickling in line heat treated specimen with the pickling solution of this invention and off line heat treated specimen treated with the pickling solution of this invention, respectively.

Specimen: SUS-304 pipe heat treated at 900–1200° C.

(1) In Line heat treated pipe, 3.5 t, outer diameter 22, length 39 mm (2) Off Line heat treated pipe, 3.0 t, outer diameter 27, length 39 mm Pickling solution:

(1) comparative pickling solution: $HNO_3$ 16%, HF 4%, residue water (2) pickling solution of this invention: nitrate 33 g/l, fluorides 33 g/l, sulfate 41 g/l, sulfuric acid 208 g/l, residue water TABLE 1a

| | | | |
|---|---|---|---|
| IMR 3000P | 03.04.1996 14:03:08 | | |
| fuel oil extra light | | | |
| NO --> $NO_2$ | | | |
| T-Gas | 24° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 22 ppm |
| $NO_2$ | 0 ppm | | |
| qA | ++++% | LAMBDA | ++++ |
| IMR 3000P | 03.04.1996 14:04:10 | | |
| fuel oil extra light | | | |
| NO -->$NO_2$ | | | |
| T-Gas | 28° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 36 ppm |
| $NO_2$ | 6 ppm | $NO_2$ | 15 ppm |
| qA | ++++% | LAMBDA | ++++ |
| IMR 3000P | 03.04.1996 14:05:11 | | |
| fuel oil extra light | | | |
| NO --> $NO_2$ | | | |
| T-Gas | 35° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 85 ppm |
| $NO_2$ | 13 ppm | | |
| qA | ++++% | LAMBDA | ++++ |
| IMR 3000P | 03.04.1996 14:06:11 | | |
| fuel oil extra light | | | |
| NO --> $NO_2$ | | | |

TABLE 1a-continued

| | | | |
|---|---|---|---|
| T-Gas | 29° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 62 ppm |
| $NO_2$ | 13 ppm | | |
| qA | ++++% | LAMBDA | ++++ |
| IMR 3000P | 03.04.1996. 14:07:10 | | |
| fuel oil extra light | | | |
| NO --> $NO_2$ | | | |
| T-Gas | 38° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 71 ppm |
| $NO_2$ | 14 ppm | | |
| qA | ++++% | LAMBDA | ++++ |
| IMR 3000P | 03.04.1996. 14:08:11 | | |
| fuel oil extra light | | | |
| NO --> $NO_2$ | | | |
| T-Gas | 36° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 74 ppm |
| $NO_2$ | 15 ppm | | |
| qA | ++++% | LAMBDA | ++++ |
| IMR 3000P | 03.04.1996. 14:09:11 | | |
| fuel oil extra light | | | |
| NO --> $NO_2$ | | | |
| T-Gas | 37° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 73 ppm |
| $NO_2$ | 17 ppm | | |
| qA | ++++% | LAMBDA | ++++ |

TABLE 1b

| | | | |
|---|---|---|---|
| IMR 3000P | 03.04.1996 13:47:08 | | |
| fuel oil extra light | | | |
| NO --> $NO_2$ | | | |
| T-Gas | 22° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 57 ppm |
| $NO_2$ | 0 ppm | | |
| qA | ++++% | LAMBDA | ++++ |
| IMR 3000P | 03.04.1996 13:48:08 | | |
| fuel oil extra light | | | |
| NO --> $NO_2$ | | | |
| T-Gas | 27° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 38 ppm |
| $NO_2$ | 0 ppm | | |
| qA | ++++% | LAMBDA | ++++ |
| IMR 3000P | 03.04.1996 13:49:08 | | |
| fuel oil extra light | | | |
| NO --> $NO_2$ | | | |
| T-Gas | 27° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 39 ppm |
| $NO_2$ | 0 ppm | | |
| qA | ++++% | LAMBDA | ++++ |

TABLE 1b-continued

| | | | |
|---|---|---|---|
| IMR 3000P | | 03.04.1996 | |
| | | 13:50:08 | |
| fuel oil extra light | | | |
| NO --> $NO_2$ | | | |
| T-Gas | 28° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 36 ppm |
| $NO_2$ | 0 ppm | | |
| qA | ++++% | LAMBDA | ++++ |
| IMR 3000P | | 03.04.1996. | |
| | | 13:51:08 | |
| fuel oil extra light | | | |
| NO --> $NO_2$ | | | |
| T-Gas | 29° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 36 ppm |
| $NO_2$ | 0 ppm | | |
| qA | ++++% | LAMBDA | ++++ |
| IMR 3000P | | 03.04.1996. | |
| | | 13:52:08 | |
| fuel oil extra light | | | |
| NO --> $NO_2$ | | | |
| T-Gas | 31° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 43 ppm |
| $NO_2$ | 0 ppm | | |
| qA | ++++% | LAMBDA | ++++ |
| IMR 3000P | | 03.04.1996. | |
| | | 13:53:08 | |
| fuel oil extra light | | | |
| NO -->$NO_2$ | | | |
| T-Gas | 33° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 45 ppm |
| $NO_2$ | 6 ppm | | |
| qA | ++++% | LAMBDA | ++++ |

TABLE 1c

| | | | |
|---|---|---|---|
| IMR 3000P | | 03.04.1996 | |
| | | 14:31:54 | |
| fuel oil extra light | | | |
| NO --> $NO_2$ | | | |
| T-Gas | 25° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |
| IMR 3000P | | 03.04.1996 | |
| | | 14:32:54 | |
| fuel oil extra light | | | |
| NO --> $NO_2$ | | | |
| T-Gas | 31° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |
| IMR 3000P | | 03.04.1996 | |
| | | 14:33:54 | |
| fuel oil extra light | | | |
| NO --> $NO_2$ | | | |
| T-Gas | 24° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |

TABLE 1c-continued

| | | | |
|---|---|---|---|
| $NO_2$ | 0 ppm | | |
| qA | ++++% | LAMBDA | ++++ |
| IMR 3000P | | 03.04.1996 | |
| | | 14:34:54 | |
| fuel oil extra light | | | |
| NO --> $NO_2$ | | | |
| T-Gas | 30° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |
| IMR 3000P | | 03.04.1996. | |
| | | 14:35:54 | |
| fuel oil extra light | | | |
| NO --> $NO_2$ | | | |
| T-Gas | 31° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |
| IMR 3000P | | 03.04.1996. | |
| | | 14:36:54 | |
| fuel oil extra light | | | |
| NO --> $NO_2$ | | | |
| T-Gas | 35° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |
| IMR 3000P | | 03.04.1996. | |
| | | 14:37:54 | |
| fuel oil extra light | | | |
| NO --> $NO_2$ | | | |
| T-Gas | 34° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |

TABLE 1d

| | | | |
|---|---|---|---|
| IMR 3000P | | 03.04.1996 | |
| | | 14:47:13 | |
| fuel oil extra light | | | |
| NO --> $NO_2$ | | | |
| T-Gas | 12° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |
| IMR 3000P | | 03.04.1996 | |
| | | 14:49:00 | |
| fuel oil extra light | | | |
| NO --> $NO_2$ | | | |
| T-Gas | 12° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | +++++% | LAMBDA | ++++ |
| IMR 3000P | | 03.04.1996 | |
| | | 14:50:00 | |
| fuel oil extra light | | | |
| NO --> $NO_2$ | | | |
| T-Gas | 24° C. | T-Room | 13° C. |

TABLE 1d-continued

| | | | |
|---|---|---|---|
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |
| IMR 3000P | | 03.04.1996 14:51:00 | |
| fuel oil extra light | | | |
| NO --> $NO_2$ | | | |
| T-Gas | 24° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |
| IMR 3000P | | 03.04.1996. 14:52:00 | |
| fuel oil extra light | | | |
| NO --> $NO_2$ | | | |
| T-Gas | 25° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |
| IMR 3000P | | 03.04.1996. 14:53:00 | |
| fuel oil extra light | | | |
| NO --> $NO_2$ | | | |
| T-Gas | 28° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |
| IMR 3000P | | 03.04.1996. 14:54:00 | |
| fuel oil extra light | | | |
| NO --> $NO_2$ | | | |
| T-Gas | 30° C. | T-Room | 13° C. |
| $CO_2$ | 0.0% | $O_2$ | 20.9% |
| CO | 0 ppm | $SO_2$ | 0 ppm |
| $H_2S$ | 0 ppm | NO | 0 ppm |
| $NO_2$ | 0 ppm | | |
| qA | ++++% | LAMBDA | ++++ |

As shown in the above table 1a–1d, when using the pickling solution of this invention, NO and $NO_2$ gas were not generated while 22–85 ppm of NO gas and 6–17 ppm of $NO_2$ gas were generated when using the comparative pickling solution.

Example 2: Measuring of Pickling Efficiency Depending on the Types of Steel

Various types of steels were pickled with comparative pickling solution containing the mixed acid and acid salt of this invention. Pickling of steels using the comparative mixed acid was conducted after the pretreatment had been proceeded.

As specimen, SUS-304 was used and the test results are presented in table 2 below. comparative pickling solution and pickling solution of this invention in Example 1 were used.

TABLE 2

Pickling time of USU-304 specimen depending on the types of steel (unit: min.)

| type | comparative pickling solution | pickling composition of this invention in Example 1 |
|---|---|---|
| L type steel | 20–60 | 20–40 |
| wire rod | 15–30 | 15–30 |
| hot rolled thick sheet | 20–40 | 20–30 |
| hot rolled sheet | 2–3 | 2–3 |
| cold rolled sheet | 0.5–1 | 0.5–1 |

*Pickling using comparative pickling solution in table 2, pickling time is the consumed time of pickling for specimen which was pretreated such as salt bath, shot blast and neutral salt bath. Pickling time used in pickling by using pickling solution of this invention was same or shorter the time consumed when using comparative pickling solution.

**Pickling using pickling solution of this invention of Example in table 2, pickling time is the consumed time for pickling for specimen without pretreated.

From the above result, it is understood that oxidation and carbonation scale of stainless steel can be removed only by pickling using the method and pickling solution of this invention without pretreatment.

Example 3: Comparing the Life Time of Pickling Solutions

Following test was conducted to compare life time of pickling solutions

Specimen: heat treated SUS-304 pipe, 2.5 t, outer diameter 2, length 35 mm

Pickling solution 1) comparative pickling solution: $HNO_3$ 16%, HF 4%, residue water. 2) pickling solution of this invention, formulation B comprising 50 g/l of amines and amides and nitric acid as additional components.

To 150 ml polyethylene beaker 100 ml of each above pickling solution was added and temperature was maintained at 50° C. and then specimen was dipped into the pickling solution. After pickling, specimen was removed from the pickling solution and then metal ion concentration of the spent pickling solution was measured. The results of this test are presented in Table 3a and 3b below.

TABLE 3a

Pickling efficiency of comparative pickling solution

| times | pickling time (min) | matal ion concentration (g/l) |
|---|---|---|
| 1 | 6 | 4 |
| 2 | 7 | 12 |
| 3 | 10 | 18 |
| 4 | 18 | 25 |
| 5 | 20 | 33 |
| 6 | 30 | 37 |
| 7 | 45 | 41 |
| 8 | 55 | 45 |
| 9 | 60 | 48 |
| 10 | 70 | 50 |

TABLE 3b

Pickling efficiency of pickling solution of this invention consisting of Formulation B and 50 g/l of amines and amides and nitric acid.

| times | pickling time (min) | metal ion concentration (g/l) | time | pickling time (min) | metal ion concentration (g/l) |
|---|---|---|---|---|---|
| 1 | 10 | 1 | 14 | 20 | 34 |
| 2 | 11 | 2 | 15 | 22 | 34 |
| 3 | 11 | 3 | 16 | 24 | 37 |
| 4 | 9 | 5 | 17 | 26 | 40 |
| 5 | 10 | 8 | 18 | 28 | 42 |
| 6 | 11 | 10 | 19 | 28 | 43 |
| 7 | 12 | 13 | 20 | 28 | 44 |
| 8 | 12 | 16 | 21 | 32 | 46 |
| 9 | 14 | 18 | 22 | 35 | 47 |
| 10 | 15 | 20 | 23 | 38 | 46 |
| 11 | 15 | 20 | 24 | 40 | 46 |
| 12 | 17 | 26 | 25 | 44 | 49 |
| 13 | 17 | 29 | 26 | 45 | 50 |

As shown in Table 3a and 3b, metal ion concentration and pickling time were remarkably increased in comparative pickling solution as the pickling solution was repeatedly used.

To the contrary, in the pickling solution of invention, metal ion concentration was not rapidly increased as the pickling solution was repeatedly used, Therefore, even though the pickling solution is repeatedly used pickling time is not increased rapidly and the pickling solution can efficiently be used in repeat.

From the above, pickling is conducted rapidly to some extent at the beginning in new comparative pickling solution containing the mixed acid of nitric acid hydrofluoric acid, but considering the total pickling amount and pickling time, pickling composition of this invention is much more efficient.

Example 4

This example is to decide optimum ratio of nitrate to fluorides in pickling solution.

Pickling was proceeded by dipping SUS-304 specimen cold rolled coil(C/R) 50×50 mm, 1.2 t sheet which had not been processed pretreatment into the pickling solution at 50° C. containing nitrate and fluorides dissolved in industrial water in different ratios. Pickling time was measured and the results are presented in table 4 below.

TABLE 4

Pickling time in various composition of nitrate and fluorides (unit: min)

| | $XNO_3$ (g/l) | | | | | | |
|---|---|---|---|---|---|---|---|
| YF (g/l) | 10 | 30 | 50 | 70 | 100 | 130 | 150 |
| 10 | 62 | 58 | 42 | 30 | 30 | 28 | 25 |
| 30 | 40 | 40 | 30 | 16 | 18 | 20 | 23 |
| 50 | 42 | 38 | 13 | 12 | 12 | 10 | 10 |
| 70 | 40 | 36 | 12 | 10 | 10 | 9 | 8 |
| 100 | 40 | 28 | 12 | 9 | 8 | 8 | 8 |
| 130 | 34 | 28 | 10 | 8 | 8 | 7 | 7 |
| 150 | 30 | 28 | 10 | 8 | 7 | 7 | 7 |

As shown in the table 4, pickling was proceeded rapidly within 7 minute when each of the amount of nitrate and fluorides was 130 g/l, but pickling rate was not directly proportional to the amount of additional components.

Considering recovery ratio of pickling solution, economical efficiency and pickling time, the most suitable amounts of nitrate and fluoride were 50–70 g/l.

Pickling solution comprising 50–70 g/l of nitrate and 50–70 g/l of fluorides will be referred to as "Formulation A". About from 40 second to 2 minute was consumed for removing scale when using comparative pickling solution containing nitric acid and hydrofluoric acid, while about from 10 to 13 minute was consumed when using the Formulation A.

Example 5

Pickling was proceeded for specimen of example 4 using the pickling solution into which sulfuric acid and mixture of 5:1 ratio by weight of sulfuric acid and sulfate were added to Formulation A of example 4 to reduce the pickling time. The results are presented in table 5 below.

TABLE 5

Pickling time when using pickling solution which sulfuric acid and the mixture of sulfuric acid/sulfate were respectively added to formulation A (unit: sec.)

| amount (g/l) | 50 | 100 | 150 | 200 | 250 | 300 | 500 |
|---|---|---|---|---|---|---|---|
| sulfuric acid | 360 | 220 | 100 | 90 | 80 | 60 | 45 |
| sulfuric acid + sulfate | 180 | 120 | 90 | 40 | 32 | 30 | 20 |

As shown in the above table 5, when pickling solution which was the mixture of Formulation A and the mixture of 5:1 ratio by weight of sulfuric acid and sulfurate was used, pickling time was largely reduced but surface of the specimen became roughened by severe corrosion.

When pickling using pickling solution comprising 250–300 g/l of mixture of 5:1 ratio by weight of sulfuric acid and sulfate, the surface of specimen was not damaged and pickling time was satisfactorily 30–32 sec.

Pickling composition which is formed by the addition of 250–300 g/l of mixture of 5:1 ratio by weight of sulfuric acid and sulfate to Formulation A will be referred to as "Formulation B".

Example 6

Pickling was proceed with similar specimen and pickling method of example 4 except that pickling composition which to "Formation B" additional component listed in the table 6 was added in the listed amount was used as pickling solution.

TABLE 6

Pickling time when using Formulation B to which additional component was added (unit: sec.)

| | amount (g/l) | | | | | | |
|---|---|---|---|---|---|---|---|
| additional component | 10 | 20 | 30 | 50 | 100 | 150 | 200 |
| peroxides | 30 | 29 | 26 | 25 | 25 | 20 | 15 |
| amines | 32 | 32 | 34 | 37 | 40 | 48 | 54 |
| nitric acid | 33 | 33 | 34 | 33 | 32 | 32 | 32 |
| mixture of 1:1 ratio by weight of peroxides and amines | 34 | 34 | 32 | 32 | 30 | 28 | 25 |
| mixture of 1:1 ratio by weight of peroxides and nitric acid | 34 | 32 | 32 | 28 | 25 | 20 | 18 |

TABLE 6-continued

Pickling time when using Formulation B to which additional component was added (unit: sec.)

| additional component | amount (g/l) 10 | 20 | 30 | 50 | 100 | 150 | 200 |
|---|---|---|---|---|---|---|---|
| mixture of 1:1 ratio by weight of amines and nitric acid | 36 | 34 | 34 | 32 | 32 | 30 | 30 |
| mixture of 1:1:1 ratio by weight of peroxides, amines and nitric acid | 34 | 32 | 32 | 32 | 30 | 30 | 30 |

As shown in the above table 6, when peroxides only was added to Formulation B, pickling rate was increased as the amount of the peroxide was increased, but surface of specimen was severely corroded and the concentration of pickling solution was difficult to maintain since peroxides were easily decomposed.

When amines only was added to Formulation B, pickling rate was decreased as the amount of the amines was increased but the increasing rate of metal ion concentration in pickling solution was reduced.

When nitric acid only was added to Formulation B, there was no remarkable changes in pickling time but increasing rate of metal ion concentration in pickling solution was somewhat decreased in comparison with Formulation B.

When mixture of 1:1 ratio by weight of peroxides and amines was added, the efficiency of pickling solution was similar to that of Formulation B; when mixture of 1:1 ratio by weight of peroxides and nitric acid was added, pickling rate was increased but specimen was severely corroded;

When mixture of 1:1 ratio by weight of amines and nitric acid was added, pickling rate was similar to that of Formulation B, but increasing rate of metal ion concentration in pickling composition was reduced; and when mixture of 1:1:1 ratio by weight of peroxides, amines and nitric acid was added, efficiency of removing for scale was similar to that of formulation B. considering the properties of additional component, economical efficiency and pickling time, it is preferred that using mixture of 1:1 ratio by weight of amines and nitric acid.

Example 7

Pickling was proceed similar method Example 4 except that the kinds of steel and pickling solution were changed. SUS-430 was used as specimen and pickling solution which the mixture of 2:1 ratio by weight of Formulation A and sulfate was dissolved in industrial water (herein after referring to as "Formulation C") was used.

Pickling results depending on the amount of Formulation C are presented in table 7 below.

TABLE 7

Pickling time of USU-430 depending on the amount of Formulation C (unit: sec.)

| amount (g/l) | 20 | 60 | 100 | 140 | 200 | 260 | 300 |
|---|---|---|---|---|---|---|---|
| time | 240 | 90 | 60 | 38 | 36 | 34 | 34 |

As shown in the above table 7, when the amount of the formulation C was more than 140 g/l, the result was considered to be satisfactory and appropriate amount of Formulation C was 140–200 g/l.

Also, as phosphoric acid was added to the above pickling solution into which appropriate amount of formulation C was added, pickling time was improved from 36–38 sec. to 31–33 sec.

Example 8

Pickling was proceeded with similar method of Example 4 except that kinds of steel and pickling solution were changed. sus-430 of Example 7 was used as specimen and pickling solution which 150 g/l of phosphoric acid was added to 140–200 g/l of Formulation (herein after referring to as "Formulation D") was used as pickling solution. And pickling results are presented in table 8 below.

TABLE 8

Pickling time depending on the type and amount of additional component (unit: sec.)

| type | amount (g/l) 10 | 20 | 30 | 50 | 100 | 150 | 200 |
|---|---|---|---|---|---|---|---|
| peroxides | 32 | 27 | 27 | 26 | 24 | 20 | 18 |
| amines | 32 | 34 | 38 | 41 | 54 | 60 | 66 |
| nitric acid | 34 | 34 | 32 | 32 | 30 | 28 | 28 |
| mixture of 1.1 ratio by weight of peroxides and amines | 35 | 35 | 34 | 29 | 27 | 25 | 24 |
| mixture of 1:1 ratio by weight of peroxides ank nitric acid | 36 | 35 | 30 | 29 | 25 | 20 | 20 |
| mixture of 1:1 ratio by weight of amines and nitric acid | 38 | 35 | 35 | 32 | 31 | 30 | 30 |
| mixture of 1:1:1 ratio by weight of peroxodes, amines and nitric acid | 35 | 33 | 33 | 32 | 30 | 31 | 30 |

As shown in the above table 8, the results of this example were similar to those of example 7.

Considering properties of additional component, economical efficiency and pickling time, it is preferred to use the pickling solution which 50–100 g/l of mixture of 1:1 ratio by weight of amines and nitric acid was added.

Example 9

There exists some difference depending on the types of steel, but generally sulfuric acid is more active than phosphoric acid. When using sulfuric acid, pickling rate was fast but steel surface was severely corroded, while when using phosphoric acid, pickling was somewhat delayed but steel surface was not severely corroded. therefore Formulation E was prepared by adding 200 g/l of mixture of 1:1 ratio by weight of sulfuric acid and phosphoric acid to Formulation C.

Pickling was conducted on similar specimen and using the pickling method of example 4 except that pickling solution which additional component listed in the table 9 was added to "Formulation E" in the listed amount was used as pickling solution. The results are presented in table 9 below.

TABLE 9

Pickling time depending on the type and amount of additional component (unit: sec.)

| type | amount (g/l) 10 | 20 | 30 | 50 | 100 | 150 | 200 |
|---|---|---|---|---|---|---|---|
| peroxides | 40 | 38 | 37 | 36 | 36 | 31 | 26 |
| amines | 43 | 41 | 45 | 46 | 51 | 59 | 53 |

TABLE 9-continued

Pickling time depending on the type and amount of additional component (unit: sec.)

| type | amount (g/l) 10 | 20 | 30 | 50 | 100 | 150 | 200 |
|---|---|---|---|---|---|---|---|
| nitric acid | 44 | 42 | 45 | 45 | 42 | 43 | 43 |
| mixture of 1:1 ratio of weight of peroxieds and amines | 44 | 43 | 43 | 44 | 36 | 29 | 29 |
| mixture of 1:1 ratio of weight of peroxides and nitric acid | 44 | 43 | 42 | 39 | 36 | 31 | 28 |
| mixture of 1:1 ratio of weight of amines and nitric acid | 46 | 45 | 44 | 42 | 42 | 40 | 39 |
| mixture of 1:1:1 ratio of weight of peroxides, amines ank nitric acid | 45 | 44 | 43 | 42 | 40 | 41 | 40 |

As shown in the above table 9, the results of this example were similar to the results of Example 6 except that pickling time was delayed about 10–12 sec. and surface roughness was a little improved.

When only Formulation E was used for pickling, pickling time was 43 sec. Considering properties of additional component, economical efficiency and pickling time, it is preferred to use the pickling solution which 50–100 g/l of mixture of 1:1 ratio by weight of amines and nitric acid was added.

Example 10

Pickling was proceed with similar specimen and pickling method of example 4 except that pickling solution which additional component listed in the table 10 was added to "Formulation A" in the listed amount was used as pickling solution. The result are presented in table 10 below.

TABLE 10

Pickling time depending on the type and amount of additional component (unit: min.)

| type | amount (g/l) 10 | 20 | 30 | 50 | 100 | 150 | 200 |
|---|---|---|---|---|---|---|---|
| peroxides | 11 | 8 | 8 | 7 | 7 | 6 | 5 |
| amines | 13 | 14 | 14 | 15 | 16 | 18 | 18 |
| nitric acid | 12 | 11 | 11 | 11 | 10 | 9 | 8 |
| mixture of 1:1 ratio by weight of peroxides and amines | 12 | 12 | 12 | 12 | 11 | 10 | 10 |
| mixture of 1:1 ratio by weight of peroxides and nitric acid | 12 | 12 | 12 | 10 | 10 | 10 | 9 |
| mixture of 1:1 ratio by weight of amines and nitric acid | 13 | 13 | 12 | 12 | 11 | 9 | 9 |
| mixture of 1:1:1 ratio by weight of peroxides, amines and nitric acid | 12 | 12 | 12 | 11 | 10 | 9 | 9 |

As shown in the above table 10, when pickling was proceeded without using sulfuric acid, sulfate or phosphoric acid, pickling time was delayed about 5–13 min. Therefore, when pickling solution of this example is used in pickling, it is preferred to conduct pickling process after the pretreatment such as salt bath and neutral salt electrolysis.

EFFECT OF THIS INVENTION

According to this invention, by using the method and composition of this invention, scales formed iron based alloy such as stainless steel are efficiently removed and noxious gases are not generated.

Further more scale removing efficiency is superior to the prior method although pretreatment is eliminated and pickling process is simplified and additionally salt and iron oxide are obtained as by-products.

What is claimed is:

1. A pickling solution used for removing scales formed on an iron-based metal alloy substrate containing chrome and/or nickel, comprising:

about 10 to 150 g/l of a nitrate for reacting with iron and nickel to form non-noxious metal compounds;

about 10 to 150 g/l of a fluoride for reacting with chrome to form non-noxious metal compounds; and about 6 to 100 g/l of an accelerator, wherein said pickling solution is an aqueous solution, and said accelerator is a mixture of a sulfate and at least one compound selected from the group consisting of sulfuric acid, phosphoric acid, phosphate, and peroxide.

2. The pickling solution as claimed in claim 1, wherein the nitrate is at least any one selected from the group consisting of sodium nitrate, barium nitrate, potassium nitrate, calcium nitrate, and ammonium nitrate, and the fluoride is at least any one selected from the group consisting of ammonium fluorosilicate, sodium fluorosilicate, magnesium fluorosilicate, acid potassium fluoride, acid ammonium fluoride, acid sodium fluoride, fluoroboric acid, ammonium fluoroborate, potassium fluoroborate, sodium fluoride, barium fluoride, and potassium fluorosilicate.

3. The pickling solution as claimed in claim 1, wherein the sulfate is at least one selected from the group consisting of magnesium sulfate, manganese sulfate, sodium sulfate, potassium sulfate, and ammonium sulfate.

4. A pickling solution used for removing scales formed on an iron-based metal alloy substrate containing chrome and/or nickel, comprising:

about 10 to 150 g/l of a nitrate for reacting with iron and nickel to form non-noxious metal compounds;

about 10 to 150 g/l of a fluoride for reacting with chrome to form non-noxious metal compounds; and about 50 to 500 g/l of an accelerator comprising a mixture of 5:1 ratio by weight of sulfuric acid and sulfate, wherein said pickling solution is an aqueous solution.

5. A pickling solution used for removing scales formed on an iron-based metal alloy substrate containing chrome and/or nickel, comprising:

about 10 to 150 g/l of a nitrate for reacting with iron and nickel to form non-noxious metal compounds;

about 10 to 150 g/l of a fluoride for reacting with chrome to form non-noxious metal compounds;

about 6 to 100 g/l of an accelerator; and about 3 to 200 g/l of an amine or amide for preventing ferrous ion from diffusing from a surface of the iron-based metal alloy substrate to the pickling solution, wherein said pickling solution is an aqueous solution, and said accelerator is a mixture of a sulfate and at least one compound selected from the group consisting of sulfuric acid, phosphoric acid, phosphate, and peroxide.

6. The pickling solution as claimed in claim 5, wherein the amine or amide is at least any one selected from the group consisting of hexamethylenediamine, diethylamine, dimethylamine, diethylethanolamine, diethylthiourea, dimethylthiourea, diethylene diamine, cyclohexyl amine, sulfuric aminoquanidine, and ethanol amine.

7. A pickling solution used for removing scales formed on an iron-based metal alloy substrate containing chrome and/or nickel, comprising:

about 10 to 150 g/l of a nitrate for reacting with iron and nickel to form non-noxious metal compounds;

about 10 to 150 g/l of a fluoride for reacting with chrome to form non-noxious metal compounds; and about 50 to 500 g/l of an accelerator comprising a mixture of 5:1 ratio by weight of sulfuric acid and sulfate; and about 3 to 200 g/l of an amine or amide for preventing ferrous ion from diffusing from a surface of the iron-based metal alloy substrate to the pickling solution, wherein said pickling solution is an aqueous solution.

8. The pickling solution as claimed in claim 7, wherein the amine or amide is selected from the group consisting of hexamethylenediamine, diethylamine, dimethylamine, diethylethanolamine, diethylthiourea, dimethylthiourea, diethylene diamine, cyclohexyl amine, sulfuric aminoquanidine, and ethanol amine.

9. A process for removing scales formed on an iron-based metal alloy substrate, which comprises:

dipping at least a metal surface of the substrate in an aqueous pickling solution containing a nitrate, a fluoride and an accelerator to remove scales formed on the metal surface, wherein said accelerator is a mixture of a sulfate and at least one compound selected from the group consisting of sulfuric acid, phosphoric acid, phosphate, and peroxide; and separating the substrate from the pickling solution.

10. The process as claimed in claim 9, further comprising regenerating the pickling solution after said separating, wherein said regenerating comprises:

filtering the pickling solution to separate a liquid phase containing metal ion dissolved during pickling and a solid phase including oxidized steel and sludge, and then recovering the solid phase;

passing the liquid phase into an ion exchange resin tube to absorb the metal ions; and recycling a resultant regenerated pickling solution for use in further process.

* * * * *

UNITED STATES PATENT AND TRADEMARK OFFICE

CERTIFICATE OF CORRECTION

PATENT NO. : 6,361,613 B2
DATED : March 26, 2002
INVENTOR(S) : Ki Won Lee

It is certified that error appears in the above-identified patent and that said Letters Patent is hereby corrected as shown below:

Column 1,
Line 1, after "PICKING" delete "METTALIC" insert therefor -- METALLIC --.
Line 13, after "hereinafter" delete "referring" and insert therefor -- referred --.

Column 3,
Line 10, before "of" delete "Non" and insert therefor -- None --.
Line 10, after "references" delete "did not".
Line 20, after "could" delete "reduces" and insert therefor -- reduce --.
Line 28, after "which" delete "is injury" and insert therefor -- are injurious --.
Line 42, after "be" delete "use" and insert therefor -- used --.
Line 65, after "which" delete "represents" and insert therefor -- represent --.

Column 4,
Line 63, after "pickling" delete "solutions" and insert therefor -- solution --.

Column 5,
Line 18, after "essential" delete "component" and insert therefor -- components --.
Line 27, after "solution" delete "in".
Line 28, before "of" (first occurrence) delete "stead" and insert therefor -- instead --.
Line 43, after "only" delete "attribute" and insert therefor -- attributes --.
Line 49, after "acid" (second occurrence) delete "are" and insert therefor -- is --.
Line 50, after "scale" delete "and".
Line 54, after "essential" delete "component" and insert therefor -- components --.
Line 62, after "solution" delete "do" and insert therefor -- does --.
Line 64, before "the" (first occurrence) delete "In stead" and insert therefor
-- Instead --.

Column 7,
Line 30, after "of" delete "he" and insert therefor -- the --.

Column 8,
Line 36, after "because" delete "that".
Line 62, after "filtrate" delete "in stead" and insert therefor -- instead --.

Column 9,
Line 6, after "pickling" delete "is proceed" and insert therefor -- proceeds --.

Column 15,
Line 34, after "nitric" delete "acid" and insert therefor -- and --.
Line 65, after "7" delete "minute" and insert therefor -- minutes --.

UNITED STATES PATENT AND TRADEMARK OFFICE

CERTIFICATE OF CORRECTION

PATENT NO. : 6,361,613 B2
DATED : March 26, 2002
INVENTOR(S) : Ki Won Lee

It is certified that error appears in the above-identified patent and that said Letters Patent is hereby corrected as shown below:

Column 16,
Line 7, after "40" delete "second" and insert therefor -- seconds --.
Line 7, after "2" delete "minute" and insert therefor -- minutes --.
Line 9, after "13" delete "minute" and insert therefor -- minutes --.
Line 47, after "pickling" delete "was proceed" and insert therefor -- proceeded by a -- .

Column 17,
Table 7, delete "USU" and insert therefor -- SUS --.

Column 18,
Table 8, delete "ank" and insert therefor -- and --.
Table 8, delete "peroxodes" and insert therefor -- peroxides --.
Line 54, before "additional" delete "which" and insert therefor -- with --.

Column 19,
Table 9, delete "peroxieds" and insert therefor -- peroxides --.
Table 9, delete "ank" and insert therefor -- and --.
Line 31, after "pickling" delete "proceed" and insert therefor -- proceeded --.
Line 32, after "solution" delete "which" and insert thererfor -- with --.
Line 35, after "The" delete "result" and insert therefor -- results --.

Signed and Sealed this

Eighteenth Day of October, 2005

JON W. DUDAS
*Director of the United States Patent and Trademark Office*